United States Patent [19]

Baker et al.

[11] 4,003,135

[45] Jan. 18, 1977

[54] SPECIMEN HOLDER AND TECHNIQUE EMPLOYED TO EFFECT A CONTINUOUS MAXIMUM CONCENTRATION GRADIENT IN CRITICAL POINT DRYING

[75] Inventors: Frederick L. Baker, Lacon; Lambertus H. Princen, Peoria, both of Ill.

[73] Assignee: The United States of America as represented by the Secretary of Agriculture, Washington, D.C.

[22] Filed: June 13, 1975

[21] Appl. No.: 586,783

[52] U.S. Cl. ..... 34/9; 34/237; 34/239; 195/139

[51] Int. Cl.[2] ..... F26B 5/00; F26B 25/18

[58] Field of Search ..... 34/237, 238, 239, 9; 195/139

[56] References Cited

UNITED STATES PATENTS

| | | | |
|---|---|---|---|
| 1,170,739 | 2/1916 | Khotinsky | 34/239 |
| 2,672,431 | 3/1954 | Goetz | 195/139 |
| 3,075,888 | 1/1963 | Achorn, Jr. et al. | 195/139 X |
| 3,488,860 | 1/1970 | Bender et al. | 34/238 |
| 3,886,047 | 5/1975 | Billups | 195/139 |

*Primary Examiner*—John J. Camby
*Attorney, Agent, or Firm*—M. Howard Silverstein; David G. McConnell; Curtis P. Ribando

[57] ABSTRACT

The present device and technique enables a small specimen to be subject to a continuous maximum concentration gradient by continually replenishing the fluid coming in contact with the specimen. Accordingly, the diffusion rate from the specimen to the fluid in contact is maintained at a high level, and the fluid-exchange steps are completed quickly. Further, the device is designed to hold a plurality of specimens so that a number of specimens can be "dried" simultaneously and quickly.

10 Claims, 5 Drawing Figures

SPECIMEN HOLDER AND TECHNIQUE EMPLOYED TO EFFECT A CONTINUOUS MAXIMUM CONCENTRATION GRADIENT IN CRITICAL POINT DRYING

BACKGROUND OF THE INVENTION

The introduction of the electron microscope made it necessary for the users thereof to dry the specimens that were going to be viewed through such a microscope. If such a specimen is not dried, the beam of electrons becomes difficult to focus; i.e., the electron beam is subjected to a moisture-contaminated "vacuum."

Originally specimens were simply air dried by exposing the specimen to the ambient air or to vacuum conditions, thus permitting the water in the specimen to evaporate. Such techniques were not entirely satisfactory since the surface tension of the water would cause a specimen to tear or be compressed during this form of drying procedure. Accordingly, a specimen so dried would wither and its three-dimensional characteristics would be distorted, thereby giving rise to a less than complete evaluation of a specimen held under an electron microscope.

At least one answer to overcoming the problem of having the specimens tear and become compressed was the introduction of the technique of critical point drying. The advantages of critical point drying were set out by T. F. Anderson in a paper entitled, "Techniques for the Preservation of Three-Dimensional Structure in Preparing Specimens for the Electron Microscope," published in the Transactions of the New York Academy of Science, Series II, 13, 130 (1951). In accordance with the critical point drying technique, the specimen containing water is first exposed (immersed) in a bath of ethanol. Thereafter the specimen is immersed in a bath of amyl acetate followed by being immersed in a bath of liquid $CO_2$. The water is miscible with the ethanol; the ethanol is miscible with amyl acetate; and the amyl acetate is miscible with the liquid $CO_2$. Accordingly, by diffusion the water is displaced by the ethanol, the ethanol is displaced by the amyl acetate, and the amyl acetate is displaced by the liquid $CO_2$. The liquid $CO_2$ is then changed to a gaseous state above the critical point so that all surface tension forces are eliminated during vaporization. By using this technique the specimen is dried, but it retains its original three-dimensional form.

The procedure described above is suitable for pieces of animal and plant tissue of reasonable size. However, no good method exists for containing such small particle materials as microorganisms or fibers. By small particle materials is meant those having diameters of from 1 to 1,000 microns. Bacteria, yeasts, and mold spores are often not larger than a few microns and are not easily contained during the critical point drying process without greatly prolonging the duration of the drying process.

The exchange of liquid during the displacement steps takes place from inside the biological cell to the surrounding medium. Such an exchange takes place by diffusion and the distances involved in the exchange are in the order of a few microns and the traveling times of the solvent molecules are in the order of 0.01 to 1 sec. The diffusion rate is directly related to the concentration gradient between the inside and outside of the cell membrane according to the equation $Q = A\ D\ P\ (\Delta C/\Delta x)\ t$ where $Q$ = solute crossing a surface area $A$, $D$ = diffusion coefficient, $P$ = the permeability factor of the membrane, $(\Delta C/\Delta x)$ = concentration gradient, and $t$ = time. It has been determined that if the concentration gradient can be maintained at a high level by the flow of liquid through the sample container, the displacement time is greatly reduced from an ordinary critical point drying procedure where the rate of liquid exchange is determined by the slow process of diffusion. It has been determined that the concentration gradient can be held at a high level by agitation but in the technique employed heretofore, agitation has not been effected easily because small particle specimens to be dried have to be confined. The present device effects the high level of concentration gradient by continuous replenishment of the fluid coming in contact with the specimen.

It is known that microorganisms can be filtered from a fluid stream by passing the stream into a holder containing a filter disposed across the stream flow, thus collecting the microorganisms on the upstream surface of the filter. For example see U.S. Pat. No. 2,672,431.

DETAILED DESCRIPTION OF THE INVENTION

The present device provides a specimen capsule which includes a threaded base which has aperture means therein to allow fluid to pass therethrough and which is further formed to have a seat to hold a pair of filters. In use, the device holds a small specimen between said pair of filters. There is further included a rubberlike seal and a retainer ring means to hold the filters on the base and a threaded cap, with an aperture therein, which is threadably fitted over the base to cause the retaining ring to come into abutment with the filters and hold them firm against said base seat. In addition the present device provides a capsule holder wherein a plurality of specimen capsules can be simultaneously located to effect critical point drying of a plurality of specimens at the same time without danger of cross-contamination.

The objects and features of the present invention will be better understood from the following description taken in conjunction with the drawings in which.

Figure 1:
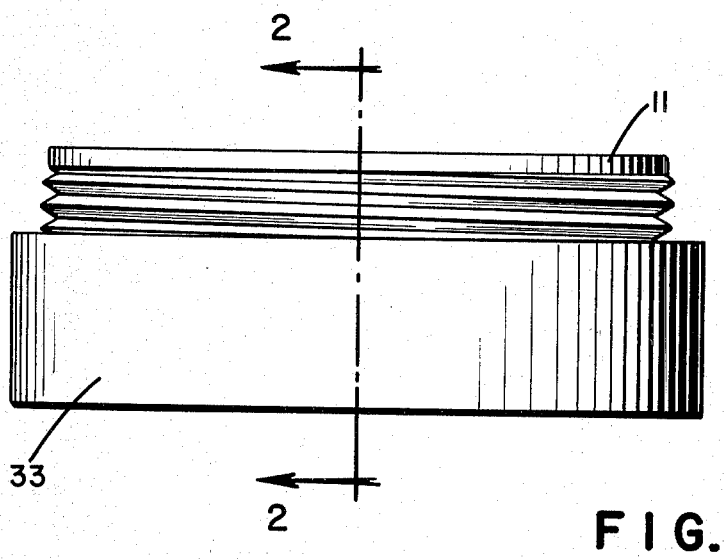
FIG. 1 is an elevation view of the specimen capsule.
Figure 2:
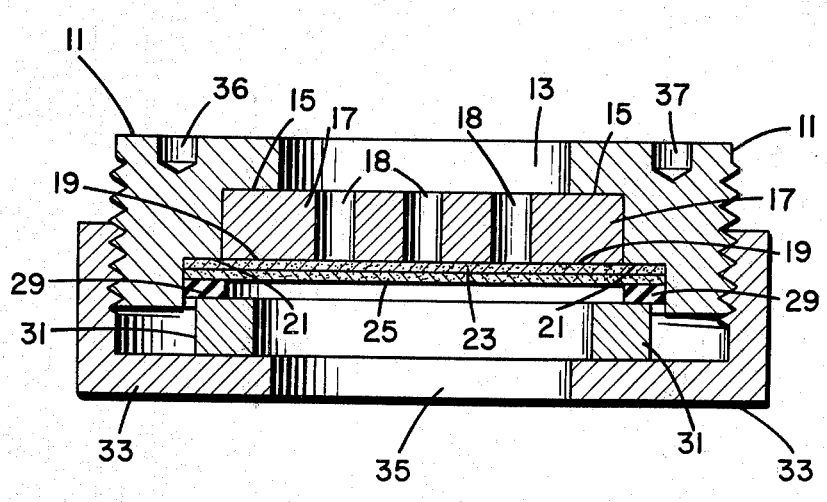
FIG. 2 is a sectionalized view of the specimen capsule along the lines 2—2 of FIG. 1.

In FIG. 2 the specimen capsule is depicted as having a base 11 which is threaded and has an aperture 13 therein. The base 11 is formed to provide a ledge 15 onto which sits a support grid 17. The support grid can be fabricated from any rigid material, such as nylon or metal, which is characterized by adequate strength and is inert to the fluids employed. In the preferred embodiment the support grid is the "Swinnex" support grid manufactured by Millipore Corporation of Bedford, Mass. As is apparent from FIG. 2, the support grid has a plurality of apertures 18 therein which allow the surrounding fluid or the fluid coming in contact with the specimen to pass therethrough. When the support grid 17 is located in the base 11, resting on ledge 15, its lower surface 19 is flush with the seat 21. It should be understood that when the capsule is being loaded with the specimen, the base is turned over from the position shown in FIG. 2 and hence the surface 19 would be the upper surface.

As can be seen in FIG. 2, filters 23 and 25 are disposed to rest on the seat 21 and the support grid 17. The specimen which is going to be dried (which generally is in the order of 10 microns or less in diameter) is held between the filters 23 and 25. The filters in the preferred embodiment are fritted silver filters. Such filters are fabricated from silver balls jointed together to create voids therebetween in the order of 0.2–1.2 microns. Silver fritted filters are used in order to provide an electrically conducting mount to enable the electrons to be conducted away, as required in scanning electron microscopy. When a specimen has been dried, it remains on the filter and is coated with a conductive metal to a thickness below 400 angstroms. If a nonmetallic filter were used and coated with only 400 angstroms of metal, it would be more apt to deteriorate under an electron bombardment; hence, the silver fritted filters are used.

Further in FIG. 2 there is depicted a rubber seal 29 which is fitted over the filters 23 and 25. On top of the rubber seal 29 is located a retainer ring 31. Thereafter a cap 33 is threaded onto the base 11. The cap 33 has an aperture 35 formed therein. As the cap 33 is threaded down the retainer ring 31 presses down against the rubber seal 29 which in turn pushes the filters 23 and 25 against the seat 21. Cap 33 and retainer ring 31 may also be combined into a single unit. In response to threading the cap 33 and the base 11 together into the capsules, all of the members such as the support grid 17, the filters 23 and 25, the rubber seal 29, and the retainer ring 31 are locked in place. The specimen capsule may also be used for larger specimens, in the order of 1 mm., by placing rubber seal 29 between filters 23 and 25. There are two notches 36 and 37 cut into the base 11 to accommodate a spanner chuck which can be employed to effect the foregoing assembly of the specimen capsule. Thereafter the specimen capsule is flipped over to assume the position shown in FIG. 2 and it is in this position that it is placed into the capsule holder FIGS. 3, 4, and 5.

Figure 3:
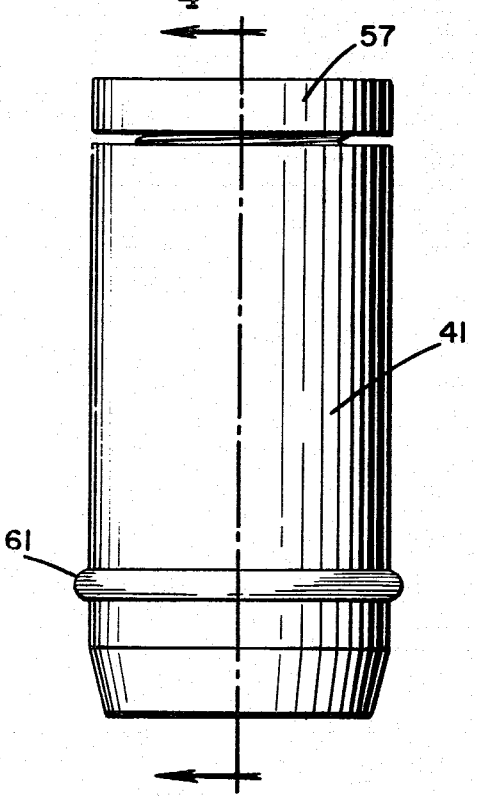
FIG. 3 is an elevation view of the specimen capsule holder.

FIG. 3 shows the capsule holder body 41 with the cylinder cap 57 and O-ring 61 in place.

Figure 4:
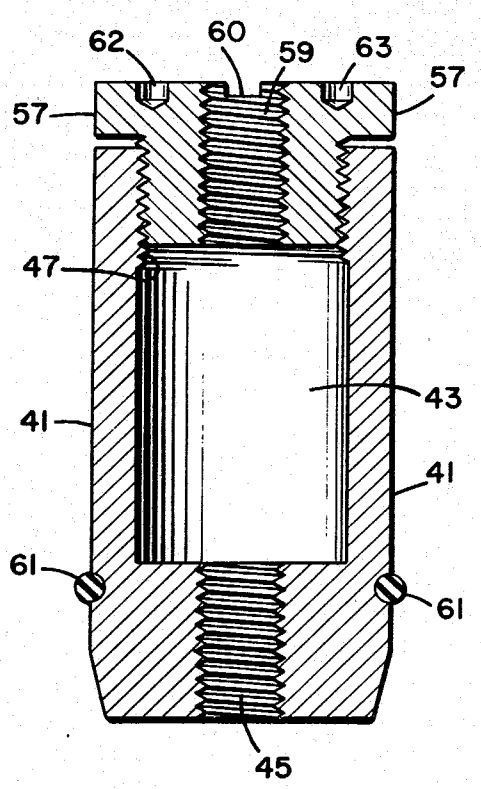
FIG. 4 is a sectionalized view of the capsule holder along lines 4—4 of FIG. 3.

In FIG. 4 the capsule holder body 41 is shown having a capsule chamber 43 therein, which has a threaded section 47 in the top portion and a threaded aperture 45 in the bottom portion.

Figure 5:
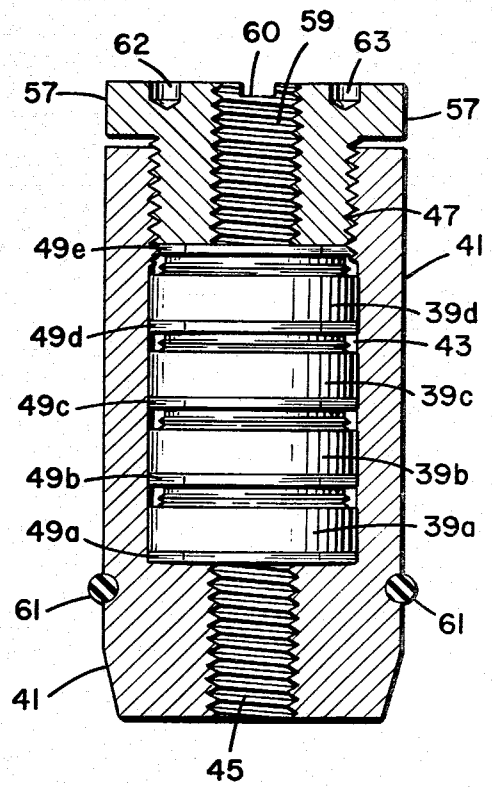
FIG. 5 is a sectionalized view of the capsule holder as in FIG. 4 holding a plurality of specimen capsules and spacers.

FIG. 5 shows the same sectionalized view of the specimen holder as shown in FIG. 4 with a plurality of specimen capsules (39*a*–39*d*) loaded in capsule chamber 43.

In the base of capsule chamber 43 there is located a "Teflon" spacer 49*a*. The lowermost capsule 39*a* is disposed on the "Teflon" spacer 49*a*. On the top of the lowermost capsule 39*a* there is disposed a "Teflon" spacer 49*b* to separate the capsules 39*a* and 39*b*. In a like manner "Teflon" spacer 49*c* separates capsules 39*b* and 39*c*, and spacer 49*d* separates capsules 39*c* and 39*d*. In addition there is a "Teflon" spacer 49*e* located between the uppermost capsule 39*d* and cylinder cap 57. Each "Teflon" spacer has a central opening to permit the fluid which comes in contact with the specimen to pass therethrough to the next higher capsule and prevents the fluid from bypassing the capsules on the outside.

When the capsules and the spacers have been stacked as shown in FIG. 5, the cylinder cap 57 is threaded into threaded section 47 to tightly clamp all of the members (capsules and spacers) as shown. Now it should be understood that while four capsulses are shown in FIG. 5 there could be more or less depending upon the size of the capsule holder. It should also be understood that other materials besides "Teflon" can be used for fabricating the spacers, the prerequisite being that the material be firm and noncorrosive.

Into the threaded aperture 45 there is threaded a tubular pipe or end piece which serves to connect a centrifugal or peristaltic pump, or any other means of obtaining pressurized liquid, to the holder. This arrangement permits any sequence of liquids to be pumped through the holder and through the capsules. The pump maintains a pressure differential of between 2 lb. to 10 lb. across the holder. The cylinder cap 57 is formed to have a threaded aperture 59 therein as well as two notches 62 and 63 which accept a spanner tool for tightening the cap 57 into capsule holder body 41 and groove 60 running across cap 57 through threaded aperture 59 for the purpose of allowing gases or vapors to escape. A pipe system of any number of varieties can be connected to aperture 59 to conduct the contact fluid away. An O-ring 61 is located somewhere on the outside of holder 41.

In operation the contact fluids (ethanol/amyl acetate) are pumped through the pipe located in threaded aperture 45 and thereafter through the first spacer 49*a*. The spacers are locked in tightly so that there is no leakage around the capsules into the space between the end of the capsules and the inside wall of capsule chamber 43. The contact fluid enters the aperture 35 (FIG. 2) of the capsule, passes through the centers of the retaining ring 31 and the rubber seal 29. The contact fluid goes through the filters 25 and 23 and on through the apertures 18 in the support grid 17. In the last step of replacing amyl acetate with liquid $CO_2$, the pipes are unthreaded, and the capsule holder is placed in the pressure vessel of an existing commercial or self-made critical point drying apparatus. The O-ring 61 prevents the liquid $CO_2$ from flowing by the holder and forces it through the capsules. This may also be accomplished by using a flat gasket either below or above the holder in the pressure vessel.

As the contact fluid passes through the filters 25 and 23, it does not pass through the specimen held between said filters. The contact fluid merely comes in contact with the specimen and takes a path of less impedance around the specimen and on through an open filter. Because there is only a small differential of pressure across the holder and because the filters per se provide an impedance to the flow of the contact fluid through the holder, the contact fluid experiences a relatively gentle flow around the specimen. This gentle flow around the specimen enables the contact fluid to be continually in a changing state so that ($\Delta C/\Delta x$), the concentration gradient, is held at a relatively high level, thereby reducing the time necessary to effect a drying by the critical drying technique. It has been found by actual performance that time to effect the drying of a specimen (or specimens if a plurality is done simultaneously) is reduced to 25% of the time critical point drying efforts took heretofore.

We claim:

1. A device for holding specimen means which are to be dried comprising in combination: base means formed to have a first aperture therein and further formed to have engageable means, said first aperture formed to provide first and second positioning means; support means having at least one aperture therein and disposed within said first aperture to be supported by said first positioning means; first and second filters formed to hold said specimen means therebetween and disposed within said first aperture to be in abutment with said support means and further supported by said second positioning means near the periphery of said filter means; cap means having a second aperture therein and formed to have engageable means to engage said engageable means of said base in order to pull said base means and said cap means toward one another; and locking means formed and disposed within said cap means to come in abutment with said filter means near the periphery of said filter means when said cap means is engaged with said base means whereby said filter means and said support means are locked tightly within said first aperture against said second and said first positioning means, respectively, said locking means formed to have third aperture means which is aligned with said first and second aperture means to enable fluid to pass through said device for holding specimen means.

2. A device for holding specimen means according to claim 1 wherein said support means is a support grid.

3. A device for holding specimen means according to claim 1 wherein said first positioning means is a first ledge formed within said first aperture means and wherein said second positioning means is a second ledge formed within said first aperture means.

4. A device for holding specimen means according to claim 1 wherein said first and second filter means are each silver fritted filters.

5. A device for holding specimen means according to claim 1 wherein said locking means includes a rubber seal with an aperture therein and which is formed and disposed to be in abutment with said filters and which locking means further includes a retainer ring formed and disposed to be in abutment with said rubber ring at one end and in abutment with said cap at its other end, said retaining ring formed to have an aperture therein.

6. A device for holding specimen means according to claim 1 wherein there is further included a capsule holder means for holding a plurality of capsules each of which includes one of said base means respectively engaged with an associated cap means.

7. A device for holding specimen means according to claim 6 wherein said capsule holder is formed to have a major aperture therethrough and wherein said major aperture is formed to have a threaded lower section and a threaded upper section.

8. A device for holding specimen means according to claim 7 wherein there is further included a holder cap means which has an aperture therein and which is formed to be threaded into said threaded upper section of said capsule holder.

9. A device for holding specimen means according to claim 7 wherein said major aperture is formed to hold a plurality of said capsules and wherein there is further included a plurality of spacer means for separating each capsule from an adjacent capsule when said plurality of capsules are held by said holder.

10. A method for drying small particle materials for viewing through an electron microscope, said method comprising:

a. placing said material between a first filter and a second filter;
b. passing ethanol through said filters and in contact with said material;
c. subsequently passing amyl acetate through said filters and in contact with said material;
d. subsequently passing liquid $CO_2$ through said filters and in contact with said material; and
e. removing said liquid $CO_2$ from said material.

* * * * *